United States Patent [19]

Horenkamp

[11] Patent Number: 5,015,031

[45] Date of Patent: May 14, 1991

[54] RECLINING CHAIR

[75] Inventor: Franz Horenkamp, Bielefeld, Fed. Rep. of Germany

[73] Assignee: Ferdinand Lusch GmbH & Co. KG., Bielefeld, Fed. Rep. of Germany

[21] Appl. No.: 398,044

[22] Filed: Aug. 23, 1989

[30] Foreign Application Priority Data

Apr. 20, 1989 [DE] Fed. Rep. of Germany ..... 8904979

[51] Int. Cl.[5] ..... A47C 1/02

[52] U.S. Cl. ..... 257/84; 297/86; 297/87

[58] Field of Search ..... 297/83, 89, 85, 86, 297/87, DIG. 7

[56] References Cited

U.S. PATENT DOCUMENTS

| | | | |
|---|---|---|---|
| 2,820,508 | 1/1958 | Lorenz | 297/84 |
| 2,827,108 | 3/1958 | Lorenz | 297/87 X |
| 2,850,078 | 9/1958 | Lorenz | 297/83 |
| 2,940,510 | 6/1960 | Schliephacke | 297/88 |
| 3,121,589 | 2/1964 | Schliephacke | 297/84 |
| 3,142,510 | 7/1964 | Fletcher | 297/89 |
| 4,544,201 | 10/1985 | Rogers, Jr. | 297/84 X |

FOREIGN PATENT DOCUMENTS

| | | | |
|---|---|---|---|
| 545254 | 8/1957 | Canada | 297/84 |

*Primary Examiner*—Peter A. Aschenbrenner
*Attorney, Agent, or Firm*—Michael J. Striker

[57] ABSTRACT

A reclining chair comprises a seat having a front end, a backrest turnably connected with the seat, a foot part connected with the front end of the seat turnable between a non-use position in which it is located under the seat and a use position in which it is located approximately at the height of the seat, stationary braces on which the seat and the foot part are provided, hinge bars each turnably connected to a respective one of the braces and provided for turning the foot part, multi-part turning fixture so that the backrest is connected with the braces and the seat through the turning fixture, the fixture including turning bar connected with a lower end of the backrest, the bar pivotally connected with the turning bar and turnably connected with the seat, and a turning lever pivotally connected with one of the stationary braces and with the bar, an abutment pin having a turning region between the turning bar and the bar and also between the bar and the turning lever, and an end abutment mounted on the one brace and limiting a turning angle of the hinge bar connected with the one brace for foot part adjustment.

4 Claims, 4 Drawing Sheets

Fig. 6
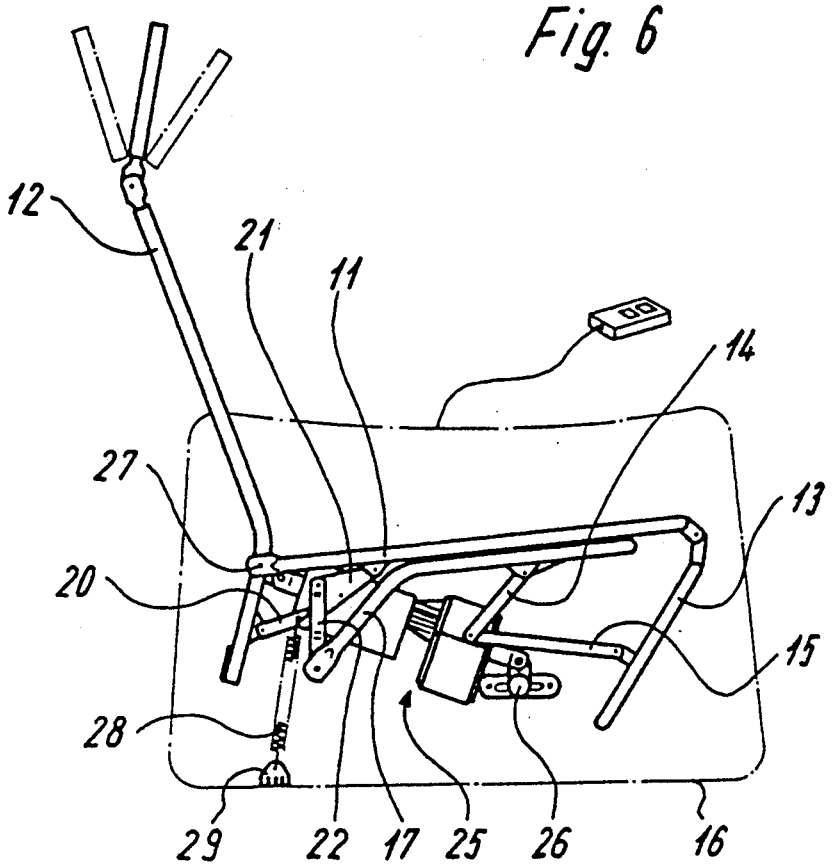
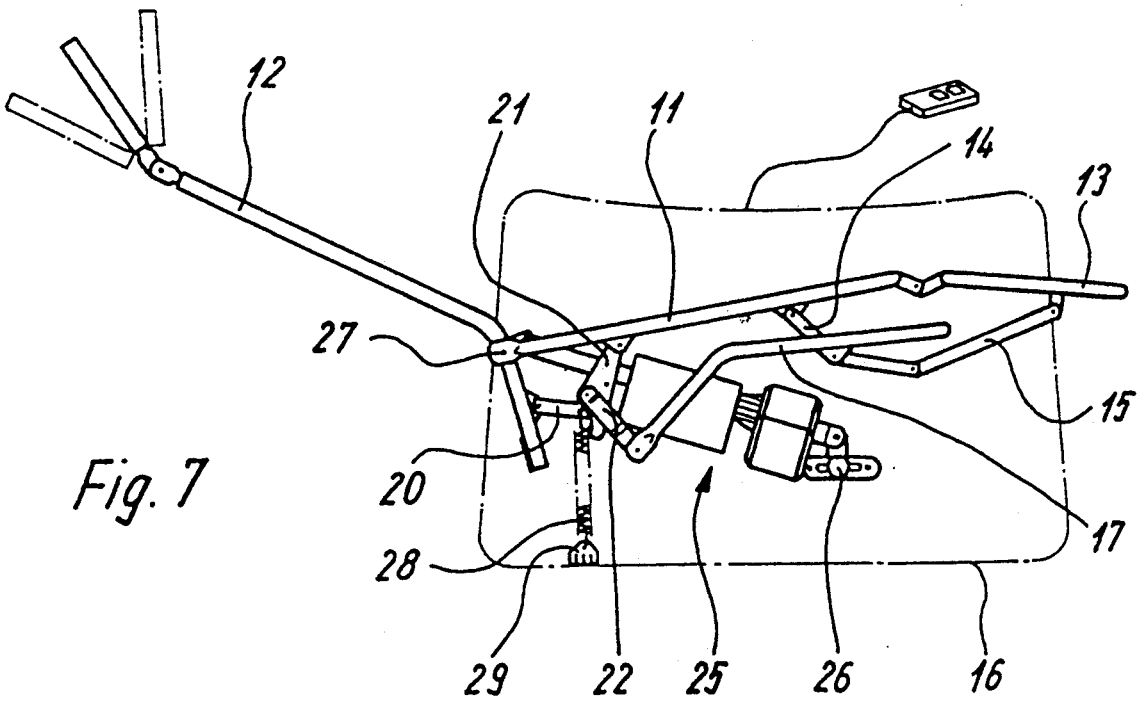
Fig. 7

RECLINING CHAIR

BACKGROUND OF THE INVENTION

The present invention relates to a reclining chair. More particularly, it relates to a reclining chair which has a seat, a backrest turnably connected with the seat, and a footrest connected with a front seat end and turnable between a non-use position under the seat and a use position substantially at the height of the seat. In such a construction, the backrest, the seat, the footrest are formed as tubular frame parts and together mounted on braces which are stationarily mounted on the side walls of the frame. For turning the foot part, two hinge bars are provided each turnably connected with a respective one of the braces.

Reclining chairs of the above-mentioned general type are known in the art. In the known construction the backrest is connected directly turnably to the stationary braces. As a result, a turning of the backrest leads forcedly to a change of the seat angle. In other words, even with insignificant turning of the backrest an increase of the seat angle occurs. For assuming of rest or intermediate positions this is not desirable.

SUMMARY OF THE INVENTION

Accordingly, it is an object of the present invention to provide a reclining chair which avoids the disadvantages of the prior art.

More particularly, it is an object of the present invention to provide a reclining chair in which many turning and adjusting positions are possible, and over a certain region of the adjustment a change of the seat angle is avoided.

In keeping with these objects and with others which will become apparent hereinafter, one feature of the present invention resides, briefly stated, in a reclining chair in which the backrest is connected with the braces an the seat through a multi-part turning fixture which includes a turning bar connected with a lower end of the backrest, a bar pivotally connected with the turning part and turnably connected with the seat, and a turning lever pivotally connected with the stationary braces and with the bar. The turning region between the turning bar and the bar one the one hand, and between the bar and the turning lever on the other hand is limited by an abutment pin, the turning angle of the hinge bars pivotally connected with the braces for the footrest adjustment is limited by an end abutment mounted on the braces.

In such a reclining chair, the seat and the backrest can be turned from the normal sitting position by turning up of the footrest, without changing the seat angle. A further turning of the backrest in direction to a lying position causes then an increase or expansion of the angle between the seat and backrest up to the lying position. Thereby a user has a plurality of possibilities to assume the intermediate positions which give him especially pleasant feelings.

In accordance with another feature of the present invention, a motor can be provided for adjusting or turning of the seat, the backrest and thereby the footrest. The motor can be connected on the one hand with the stationary transverse brace and on the other hand with the backrest.

Still a further feature of the present invention is that the motor is connected to the backrest in the turning region between the backrest and the seat.

In accordance with a further feature of the present invention, for position securing of the turning bars, springs are provided. The springs can be connected on the one hand with the turning bars, and on the other hand with the seat.

In the event when the motor is provided, the springs are connected on the other hand to the stationary bar in a bottom region, for actuating the turnable part.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6 is a side view substantially corresponding to the side view of FIG. 1, but showing the reclining chair in accordance with a further embodiment of the invention; and FIG. 7 is a view schematically showing the reclining chair of FIG. 6 in a lying position.

DESCRIPTION OF THE PREFERRED EMBODIMENTS

Figure 1:
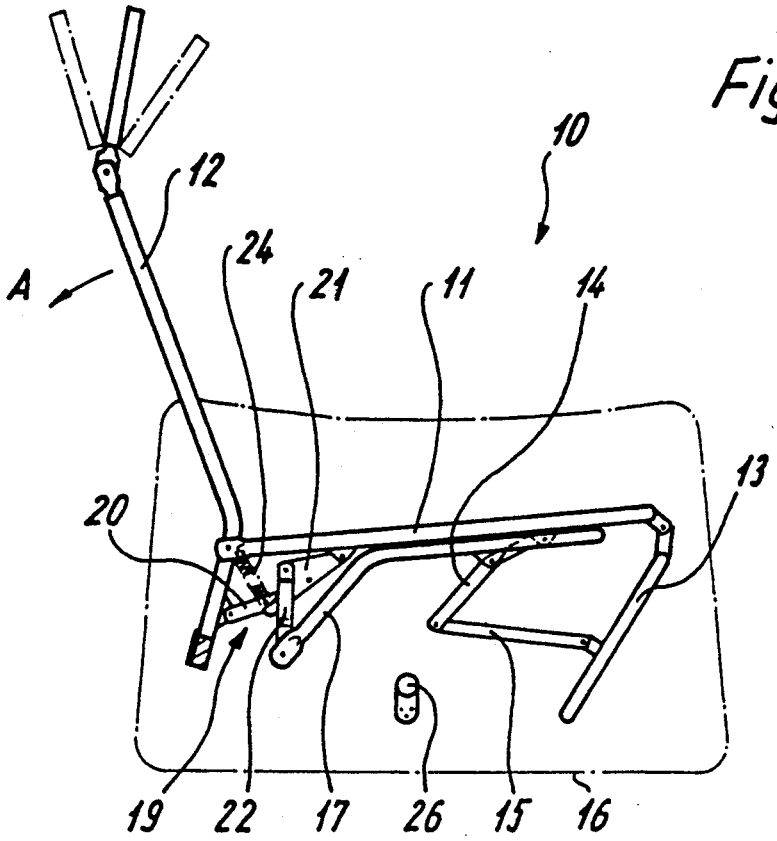
FIG. 1 is a schematic side view of a new reclining chair in accordance with the present invention in a sitting position.

A reclining chair in accordance with the present invention shown in FIGS. 1–4 is identified as a whole with reference numeral 10. It has a seat 11, a backrest 12 and a footrest 13 connected with the front seat end. The foot part 13 can be formed as a closed tubular frame.

Figure 3:
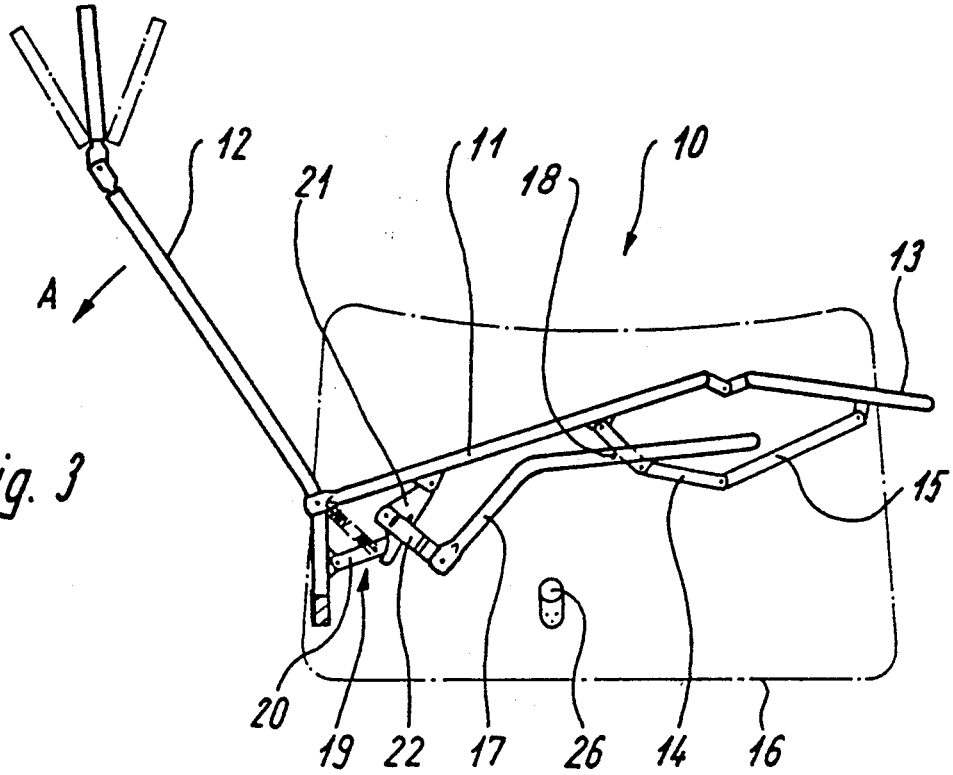
FIG. 3 is a view which schematically shows a further intermediate turning position of the invention reclining chair.
Figure 4:
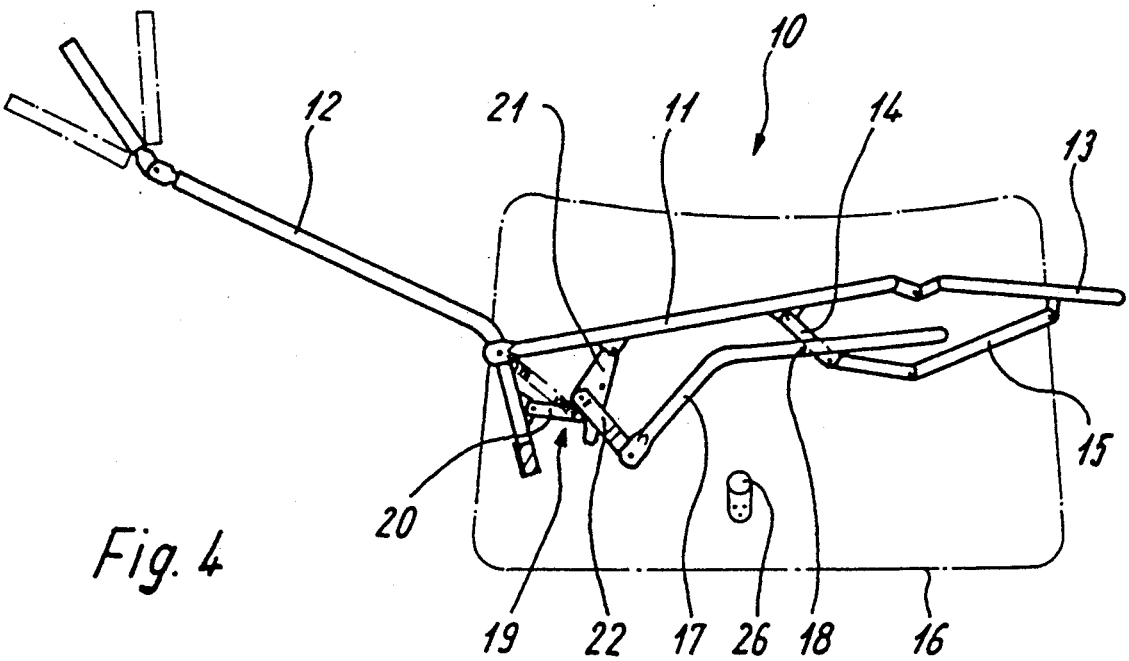
FIG. 4 is a side view of the inventive reclining chair of FIGS. 1–4 in a lying position.

The footrest 13 is turnable to a use position through two hinge bars 14 and 15 which are arranged at both longitudinal sides of the reclining chair. In the use position the footrest 13 is located approximately at the height of the seat 11 as can be seen in FIGS. 3 and 4.

The seat 11 and the backrest 12 are also formed advantageously as tubular frame parts and mounted on braces 17 which are fixedly mounted on frame side walls 16 of the reclining chair 10. The braces 17 can be formed as side parts of a U-shaped tubular frame which preferably is rearwardly open.

The hinge bar 14 for turning the footrest 13 is turnably coupled in a known manner on the brace 17 and pivotally connected by its with the seat 11. On the other hand this hinge part is turnably connected with a second hinge bar 15 which in turn is pivotally connected with the footrest 14. In the turning path of the hinge bar 13 an end abutment 18 is provided on the respective brace 17 limiting the maximum turning angle of the bar 14.

Figure 5:
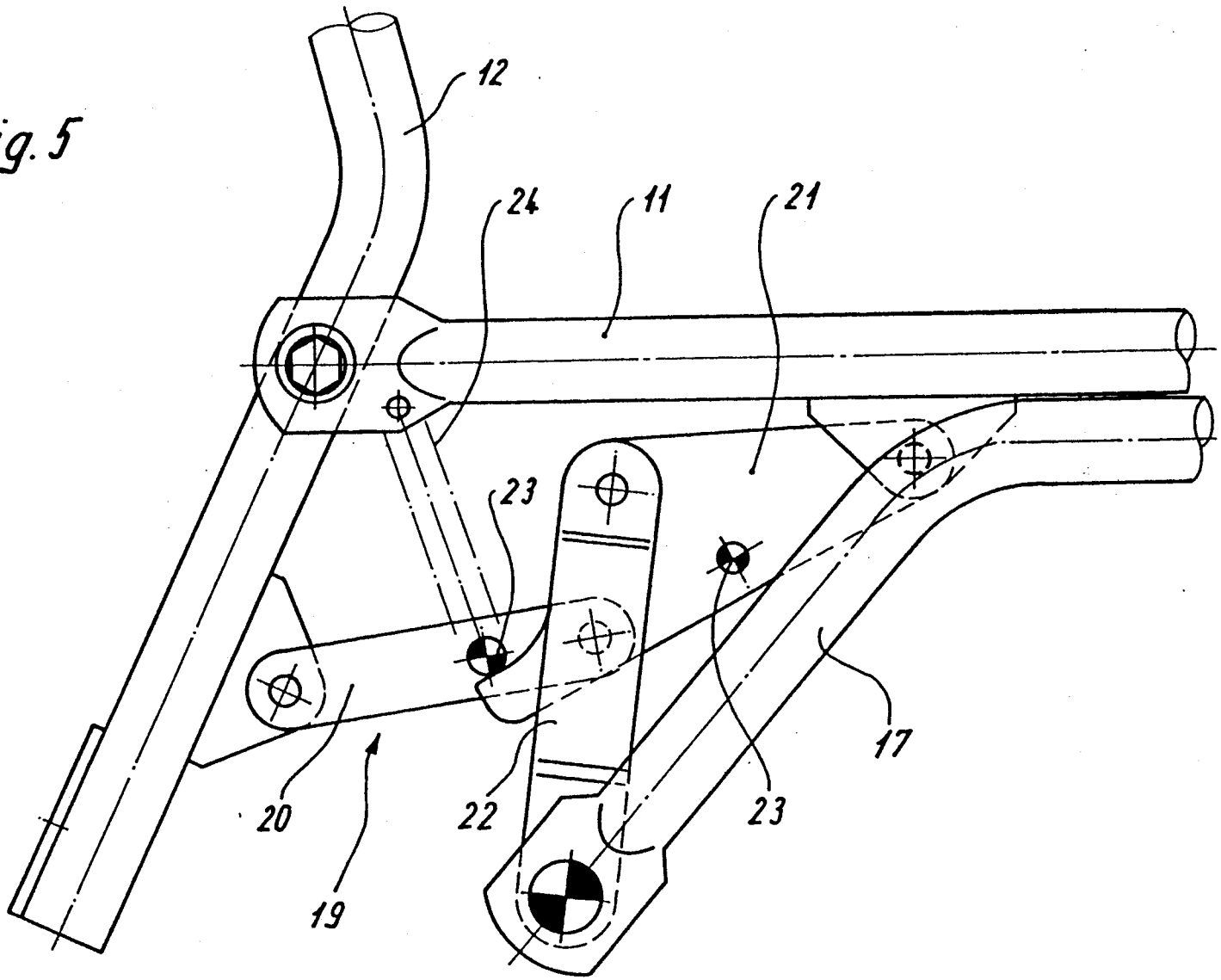
FIG. 5 is an enlarged view showing a turning fixture for a backrest of the reclining chair of FIGS. 1–4.

As can be seen from FIGS. 1–4, the backrest 12 is connected with the braces 17 and the seat 11 by a multi-part turning fixture 19. In the shown examples turning fixtures 19 are located at both longitudinal sides of the reclining chair. Such a multi-part turning fixture is shown on an enlarged scale in FIG. 5.

Each turning fixture 19 includes a turning bar 20 connected with the lower end of the backrest 12, a bar 21 on the one hand connected pivotally with the turning bar 20 and on the other hand connected turnably with the seat, and a turning lever 22 which on the one hand is connected with the stationary brace 17 and on the other hand is connected with the bar 21.

Turning angle between the turning bar 20 on the one hand and the bar 21 on the other hand, is limited by an abutment pin 23. Similarly, the turning angle between the bar 21 and the turning lever 22 is limited by an abutment pin 23 mounted on the bar 21.

The above described construction operates in the following manner:

When the backrest 12 is turned from its main position shown in FIG. 1 in direction of the arrow A downwardly the seat 11, simultaneously the seat 11 is taken along without changing the seat angle between the backrest 12 and the seat 11. By actuation of the hinge 14 and hinge bar 15 the footrest 13 is turned upwardly from its non-use position. The seat 11 during this first turning phase is lowered downwardly to its rear region. The multi-part fixture 19 operates during this first adjustment phase so that without any effect of the main position between the hinge part 20 and the part 21, a turning of the turning lever 22 occurs.

Figure 2:
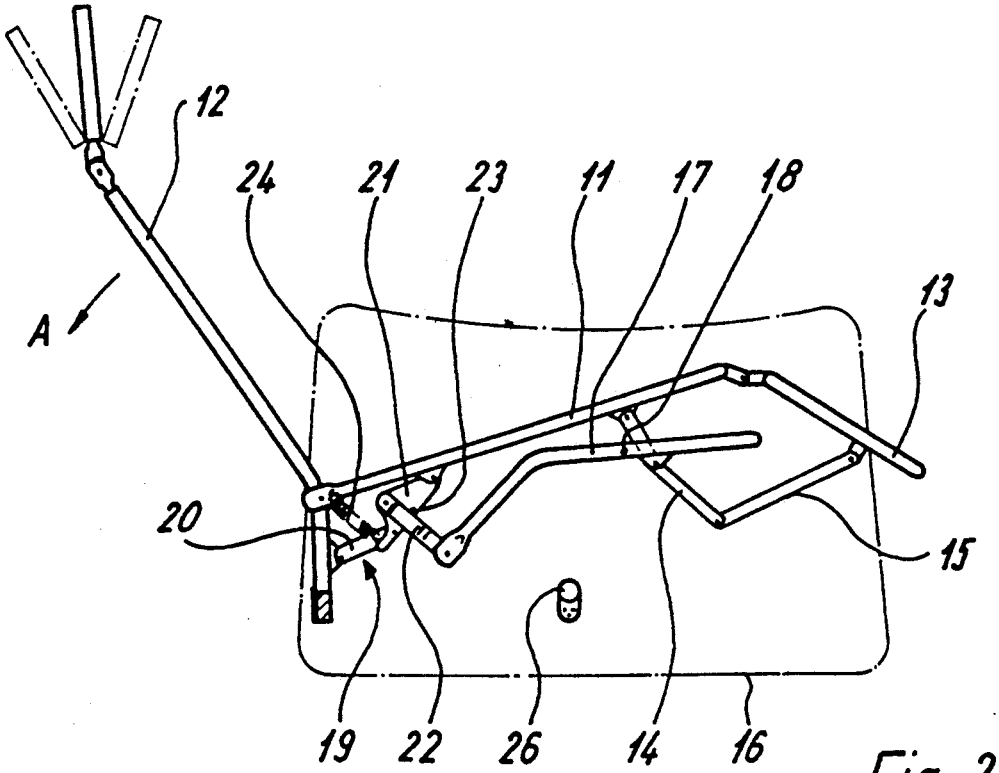
FIG. 2 is a schematic side view of the reclining chair of FIG. 1 in an intermediate turning position.

FIG. 2 shows that the possible turning region between the bar 21 and the turning lever 22 is scooped, since the turning lever 22 abuts against the abutment pin 23. A further turning of the backrest 12 in direction of the arrow A in FIG. 1 leads to an increase of the seat angle between the backrest 12 and the seat 11, since now the turning bar 20 is turned against the bar 21. In FIG. 3 the hinge bar 14 for the foot part turning reaches the end abutment 18 and cannot be turned any more. When from the position of FIG. 3 a further turning of the backrest in direction of the arrow A is performed, the seat angle between the backrest 12 and the seat 11 is permanently greater up to the lying position shown in FIG. 4. The seat 11 in its rear end region is again lifted.

In the embodiment of FIGS. 1–4 the reclining chair 10 is brought in different turning positions by body pressure of the user. For holding the respective multi-part turning fixture 19 in its operational position, a spring 24 is provided. The spring is connected on the one hand to the turning bar 20 and on the other hand to the seat 11.

In the embodiment shown in FIGS. 6 and 7, the turning of the seat 11 and the backrest 12 and also the footrest 13 is performed in a known manner by a motor 25. The motor is connected on the one hand to a stationary transverse brace 26 and on the other hand, to the backrest 12 near a hinge 27 between the backrest 12 and the seat 11. Also, a spring 28 is provided here for holding the functional parts of the multi-part turning fixture 19 in predetermined positions. This spring engages the turning bar 20. However, on the other hand it is connected in a bottom region to a stationary bar 29.

The fixture parts and operation of the reclining chair 10 in accordance with FIGS. 6 and 7 are identical to those of the reclining chair 10 of FIGS. 1–4. Therefore, additional description of this embodiment in further detail can be dispensed with.

The tubular frame construction including the seat 11, the backrest 12 and the footrest 13 mounted on the stationary braces 17 can be upholstered when necessary. A manufacturer of a reclining chair can come to various embodiments of the reclining chair with the same basic elements as a result.

It will be understood that each of the elements described above, or two or more together, may also find a useful application in other types of constructions differing from the types described above.

While the invention has been illustrated and described as embodied in a reclining chair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A reclining chair, comprising a seat formed as a tubular frame and having a front end; a backrest formed as a tubular frame and directly pivotally connected with said seat; a footrest formed as a tubular frame and directly pivotally connected with said front end of said seat, said footrest being pivotable relative to said seat between a non-use position in which said footrest is located under said seat, and a use position in which it is located approximately at a height of said seat; opposite side walls; stationary braces fixedly arranged on said side walls for supporting said seat and said footrest; hinge bars pivotally connected to said braces and to said footrest for pivoting said foot rest between the non-use and use positions thereof; a multi-partite pivoting fixture for pivotally connecting said brackrest with said seat and said braces; said multi-partite pivoting fixture including a first bar having opposite ends and being pivotally connected to a lower end of said backrest at one of said opposite ends, a second bar pivotally connected to another of said opposite ends of said first bar and to said seat, a pivoting lever pivotally connected to said second bar and one of said braces and first and second abutment pins secured to said first and second bar, respectively, for limiting pivotal movement of said second bar relative to said first bar and of said pivoting lever relative to said second bar; and an end abutment mounted on said braces for limiting a pivotal angle of said hinge bars to thereby limit pivotal movement of said footrest relative to said seat.

2. A reclining chair as set forth in claim 1, further comprising a stationary transverse brace, and a motor connected to said stationary transverse brace and said backrest for pivoting said backrest relative to said seat.

3. A reclining chair as set forth in claim 2, further comprising hinge means for pivotally connecting said backrest with said seat, said motor bring connected with said backrest at a location adjacent to said hinge means.

4. A reclining chair as set forth in claim 1, further comprising a spring connected to said seat at one end of said spring and to said multi-partite pivoting fixture at another end of said spring.

* * * * *